US006958727B2

(12) United States Patent
Peng

(10) Patent No.: US 6,958,727 B2
(45) Date of Patent: Oct. 25, 2005

(54) DIVERSIFIED PLANAR PHASED ARRAY ANTENNA

(75) Inventor: Sheng Y. Peng, Lake Forest, CA (US)

(73) Assignee: Antstar Corporation, Lake Forest, CA (US)

( * ) Notice: Subject to any disclaimer, the term of this patent is extended or adjusted under 35 U.S.C. 154(b) by 0 days.

(21) Appl. No.: 10/330,371

(22) Filed: Dec. 27, 2002

(65) Prior Publication Data

US 2004/0001023 A1 Jan. 1, 2004

(30) Foreign Application Priority Data

Jun. 28, 2002 (TW) ..... 091114271 A

(51) Int. Cl.[7] ..... H01Q 1/36
(52) U.S. Cl. ..... 343/700 MS; 343/806
(58) Field of Search ..... 343/700 MS

(56) References Cited

U.S. PATENT DOCUMENTS 6,292,154 B1 * 9/2001 Deguchi et al. ..... 343/806

6,369,762 B1 * 4/2002 Yanagisawa et al. 343/700 MS

* cited by examiner

*Primary Examiner*—James Vannucci
(74) *Attorney, Agent, or Firm*—Dellett & Walters

(57) ABSTRACT

A diversified planar phased array antenna includes a dielectric plate, at least two antenna units, at least one first micro-strip line and a ground layer. Two antenna units formed on the dielectric are coplanar and are connected perpendicular together by the first micro-strip line to form one with vertical field polarization and one with horizontal polarization. Each antenna unit is composed of at least two identical meander line antennas which have unique dual linear polarization property and at least one second micro-strip line connected to the at least two meander line antennas. The first micro-strip line is connected to at least two second micro-strip lines of the two antenna units. Therefore, the planar phased array antenna meets the requirements for spatial diversity, polarization diversity, radiation diversity and frequency diversity, etc. Each antenna unit can be formed by different number of meander line antennas which is determined to be the best for a specific application.

6 Claims, 9 Drawing Sheets

- The measured maximum gain is 2.71dBil
- Measured typical radiation pattern at f=2.45GHz

- The measured maximum gain is 6.67dBil
- Measured typical radiation pattern at f=5.25GHz

- The maximun gain is normalized to 0dB
- The measured maximum gain is 1.23dBil
- V-Polarization
- Azimuth plane

- The measured gain is normalized to 0 dB
- The measured maximum gain is 5.88 dBil
- V-Polarization
- Azimuth plane

DIVERSIFIED PLANAR PHASED ARRAY ANTENNA

BACKGROUND OF THE INVENTION

1. Field of the Invention

The present invention relates to a planar phased array antenna, more specifically to a planar phased array antenna that has spatial diversity, polarization diversity, radiation diversity, frequency diversity, etc. to minimize interference for wireless signals in open space.

2. Description of Related Art

An "antenna" for a wireless communication system is an important and necessary element and has to fulfil two requirements. One is the "frequency and bandwidth requirement," and the other is the "pattern and polarization matching requirement." Wireless signals in open space are easily susceptible to interference so that the antennas have other features for solving the following problems:

1. Multi-path Phase Cancellation,
2. Wave Depolarization,
3. Pattern Distortion,
4. Frequency Bandwidth,
5. Radiation Hazard,
6. Size, Weight and Shape, and
7. Others.

Most of the forgoing problems affect the quality of wireless signals. The Multi-path Phase Cancellation, Wave Depolarization, Pattern Distortion and Frequency Bandwidth problems can be solved by "Adaptive Antenna Diversity" techniques. That is, the antenna has polarization directions, varieties of electric wave fields, etc., or many antennas are integrated into a single antenna to form a diversity phased-array antenna.

The present invention provides a new planar, phased array antenna with an Adaptive Antenna Diversity technique to fulfil all requirements for a good antenna.

SUMMARY OF THE INVENTION

An objective of the present invention is to provide a planar phased array antenna that has spatial diversity, polarization diversity, radiation diversity, frequency diversity, etc. to solve interference problems of wireless signals in the open space.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
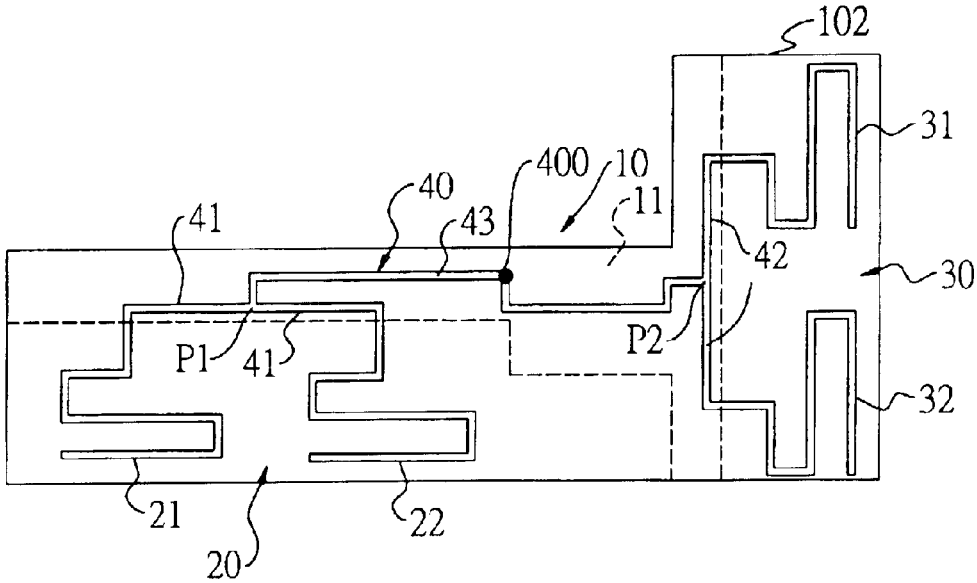
FIG. 1 is a top view of a first embodiment of a phased array antenna in accordance with the present invention.

With reference to FIG. 1, a first preferred embodiment of a phased array planar antenna in accordance with the present invention comprises a dielectric plate (10), at least two planar printed antenna units (20, 30), at least one first micro-strip line (40) and a ground layer (11). The dielectric plate is made of a dielectric material and has a top face (not numbered), a bottom face (not numbered) and a specific thickness. The dielectric material can be FR-4, mylar, ceramic, kapton, etc. The dielectric plate (10) can be any shape. The two antenna units (20, 30) and the first micro-strip line (40) are printed on the top face of the dielectric plate. The first micro-strip line (40) has two ends (not numbered) and connects the two antenna units (20, 30). Each antenna unit (20, 30) is composed of at least two meander line antennas (21, 22 and 31, 32) and at least two second micro-strip lines (41, 42).

In the first preferred embodiment the two antenna units (20, 30) are coplanar and are connected perpendicular to each other on the top face of the dielectric plate (10) so one antenna unit (20) has vertical polarization and the other antenna unit (30) has horizontal polarization. Each antenna unit (20, 30) is composed of the two identical meander line antennas (21, 22 and 31, 32) and the two second micro-strip lines (41, 42). The two identical meander line antennas (21, 22 and 31, 32) are connected together by two second micro-strip lines (41, 42), and the two second micro-strip lines (41, 42) connect to each other at a joint (P1, P2). The opposite ends of the first micro-strip line (40) are connected respectively to the joints (P1, P2) between the two second micro-strip lines (41, 42). Thus, the two antenna units (20, 30) are connected together by the first micro-strip line (40). Further, two distances from the center (400) of the first micro-strip line (40) to the two points (P1, P2) between the two second micro-strip lines (41, 42) are equal to form a single point feed at the center (400) as an input point of the antenna. The dielectric plate (10) can be an L-shape having one long leg (101) and a perpendicular short leg (102) based on the shape and arrangement of the two antenna units (20, 30). That is, the two antenna units (20, 30) are respectively printed on the long and the short parts (101, 102) of the dielectric plate (10). The ground layer (11) is formed on the bottom face of the dielectric plate (10). The ground layer (11) corresponds to the first and second micro-strip lines (40, 41, 42) on the top face.

The forgoing phased array antenna has the following features:

1. Spatial Diversity:

The planar phased array antenna has two antenna units (20, 30) that are physically separated so the phased array antenna fulfils the spatial diversity requirement.

2. Polarization Diversity:

The planar phased array antenna has one two-element meander line antenna unit (30) with dual linear polarization placed vertically and one two-element meander line antenna unit (20) with dual linear polarization placed horizontally to fulfil the polarization diversity requirement.

3. Radiation Diversity:

The two antenna units are coplanar and are connected perpendicular on the top face so the two electric wave fields are measured. The two electric wave fields are at a 90° angle to each other. Therefore the planar phased array antenna fulfils the requirement for radiation diversity.

The planar phased array antenna as described uses two antenna units (20, 30) composed of meander line antennas (21, 22 and 31, 32) and are arranged in an L-shape through the first micro-strip line (40), so that the planar phased array antenna fulfils the forgoing listed requirements.

Figure 2:
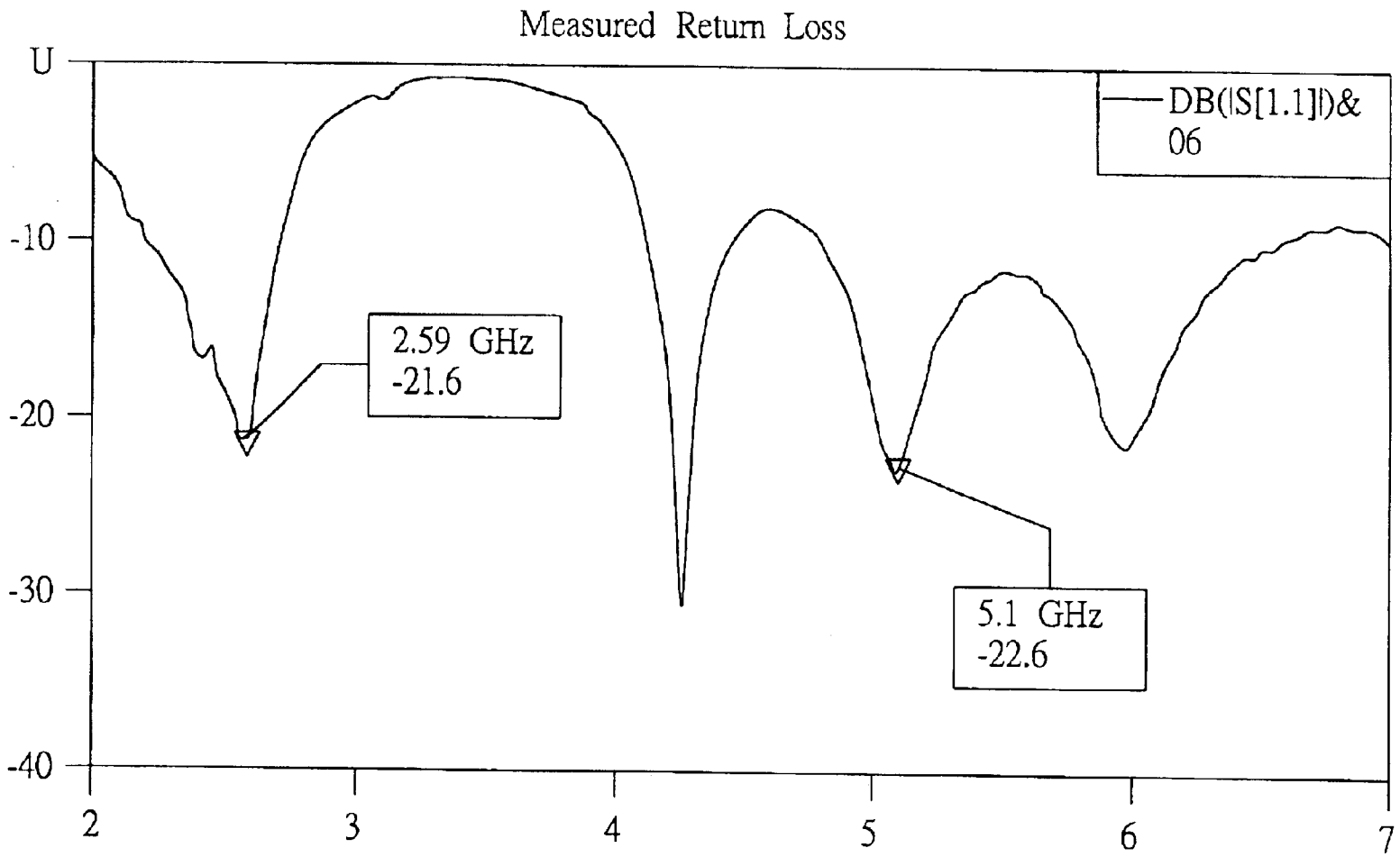
FIG. 2 is a plot of the attenuation versus frequency characteristic of the phased array antenna in FIG. 1.
Figure 3:
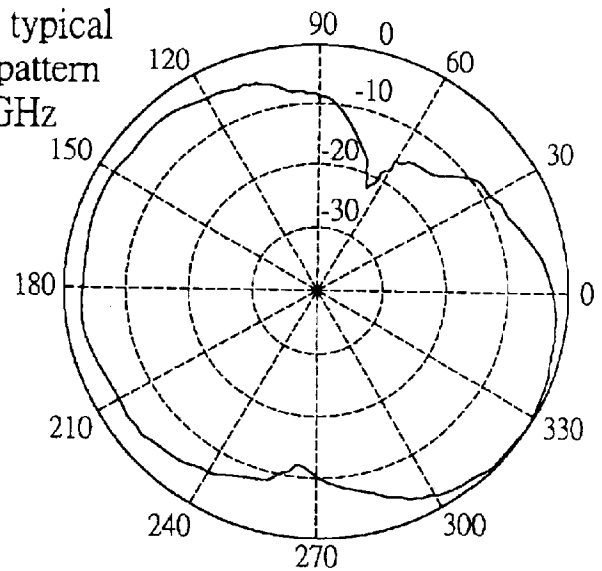
FIG. 3 is a plot of radiation gain pattern of the phased array antenna in FIG. 1.
Figure 3:
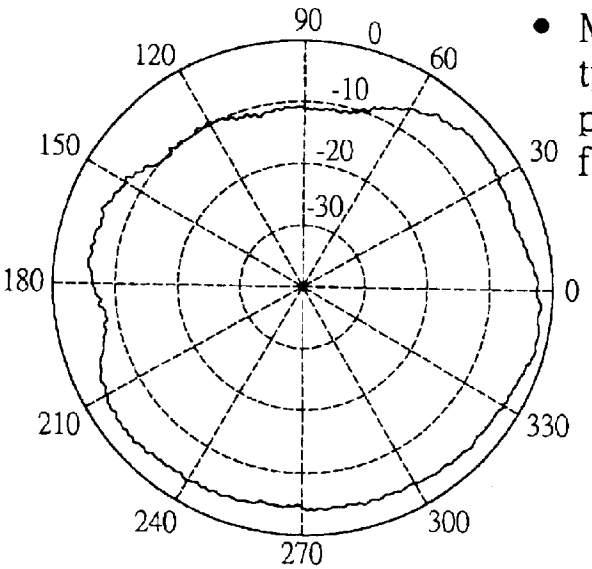
Figure 4:
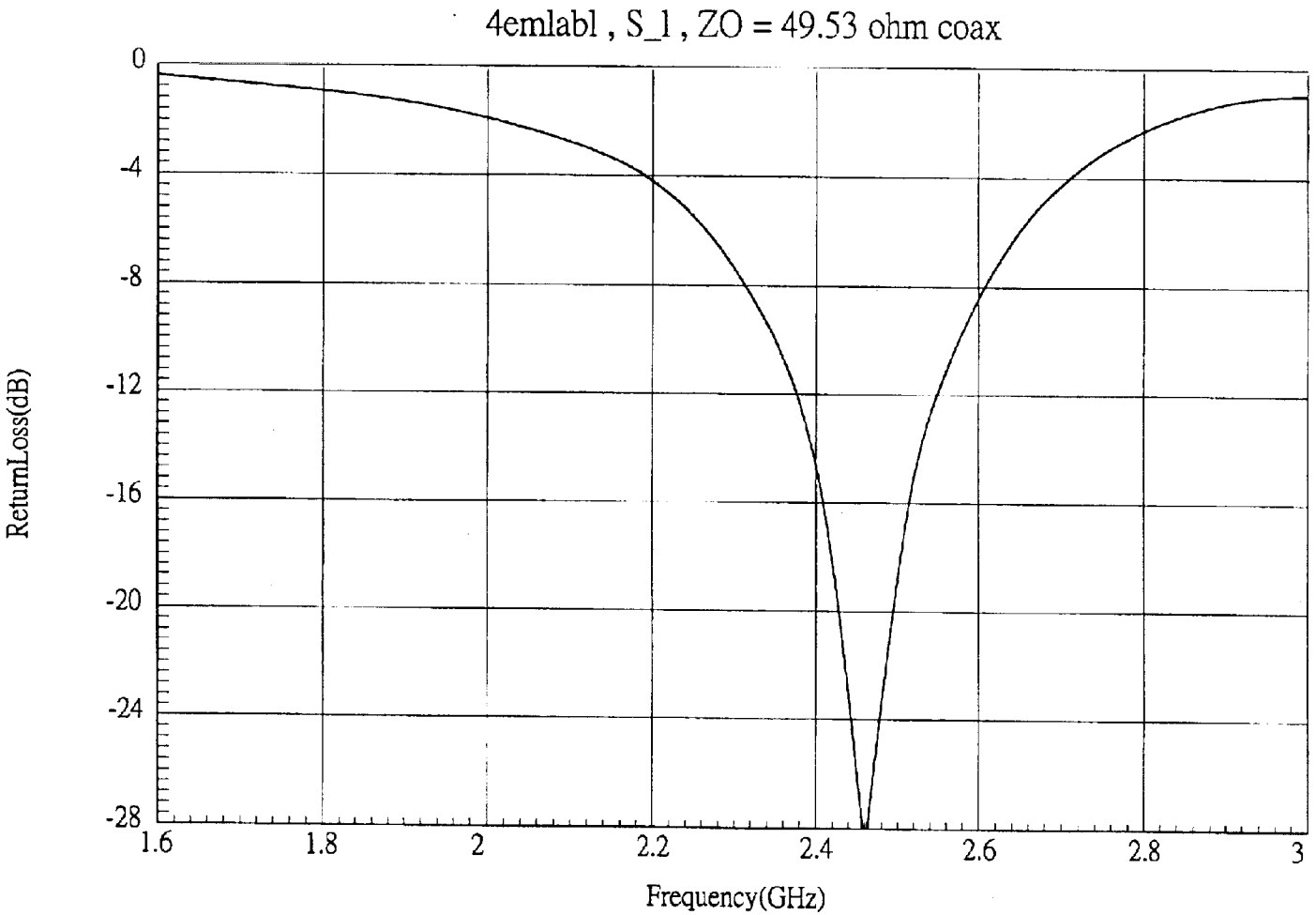
FIG. 4 is a plot of simulated Return Loss versus Frequency characteristic of the phased array antenna in FIG. 1.

With reference to FIG. 2, the return loss of the planar phased array antenna at 2.59 GHz is 21.2 dB. Specifically, the planar phased array antenna has very low return loss at the desired operational frequency. The bandwidth of the planar phased array antenna is greater than 400 MHz at −10 dB return loss when the voltage standing wave ratio (VSWR) of the antenna is 2:1. Furthermore and with reference to FIG. 4, the return loss of the antenna at 2.46 GHz is calculated −28 dB. The bandwidth of the antenna is about 300 MHz if the voltage standing wave ratio (VSWR) of the antenna is 2:1. Based on the results shown in FIGS. 2 and 4, return loss and the bandwidth of the planar phased array antenna are very good. The standard bandwidth for wireless communication is from 2.4 to 2.5 GHz. The associated radiation gain pattern (typical) is shown in FIG. 3. It should be noted that the frequency used for radiation gain pattern measurement is at 2.45 GHz (fist band). In addition, the second band frequency is at 5.25 GHz as also shown in FIG. 3. These results show excellent frequency diversity property.

Figure 5:
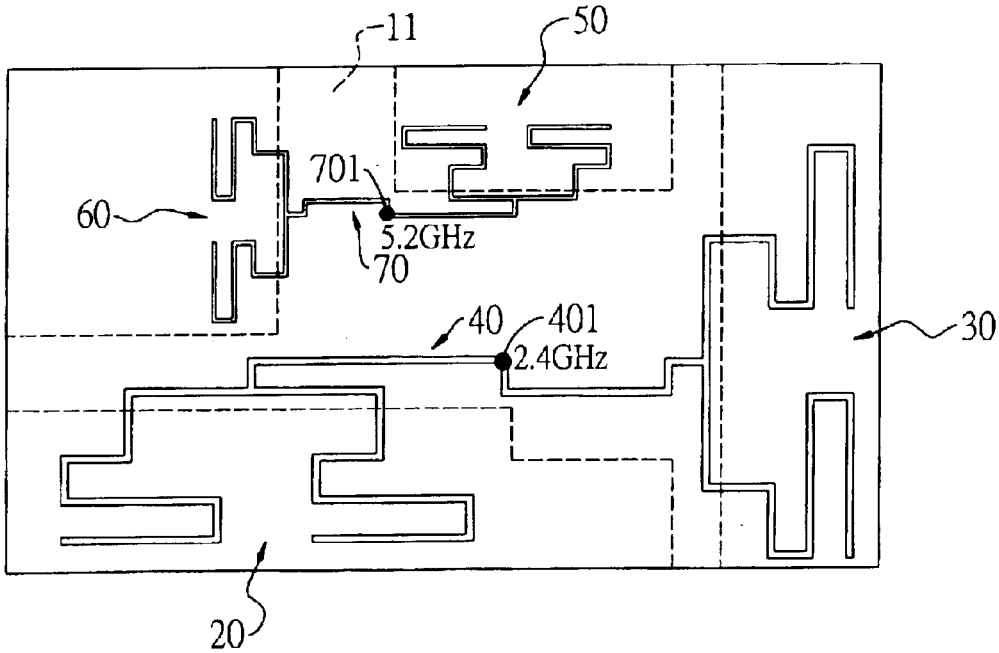
FIG. 5 is a top view of a second embodiment of a planar phased array antenna in accordance with the present invention.
Figure 6:
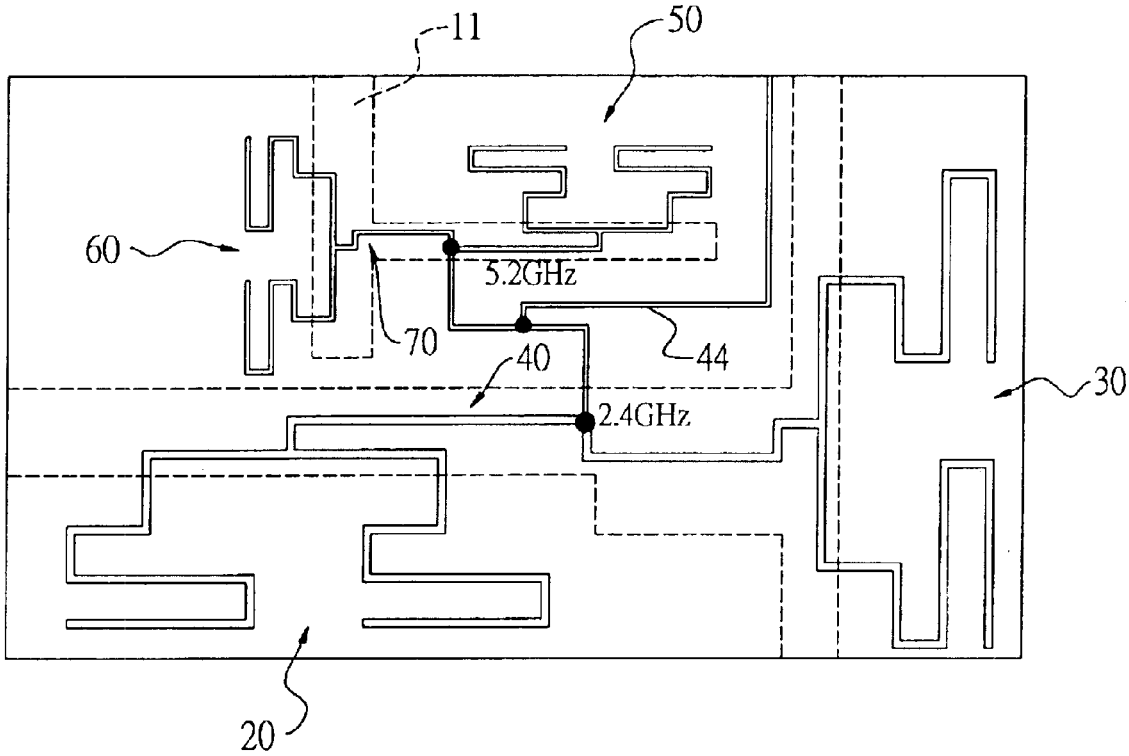
FIG. 6 is a top view of a third embodiment of a planar phased array antenna in accordance with the present invention.

With reference to FIGS. 5 and 6, a second preferred embodiment of the planar phased array antenna differs from the first in that the dielectric plate (10) of the planar phased array antenna has four antenna units (20, 30, 50, 60). The four antenna units (20, 30, 50, 60) are respectively connected together by two first micro-strip lines (40, 70) like the first preferred embodiment. Two connected antenna units (20, 30) (50, 60) have two operating frequency bands (2.4 GHz to 2.5 GHz and 5.15 GHz to 5.25 GHz), so that the four antenna units (20, 30, 50, 60) have two operating frequencies. That is, each of the first micro-strip lines (40, 70) has one feeding point, and the two operating frequencies of two feeding points (401, 701) is 2.4 GHz band and 5.2 GHz band. Furthermore and with reference to FIG. 6, a micro-strip feed line (44) is connected between the two feeding points (401, 701) to connect the four antenna units (20, 30, 50, 60) together to form a dual frequency band antenna. The micro-strip feed line (44) has only one input and output terminal (not numbered). The second preferred embodiment of the planar phased array antenna indeed fulfils many diversity requirements.

Figure 7:
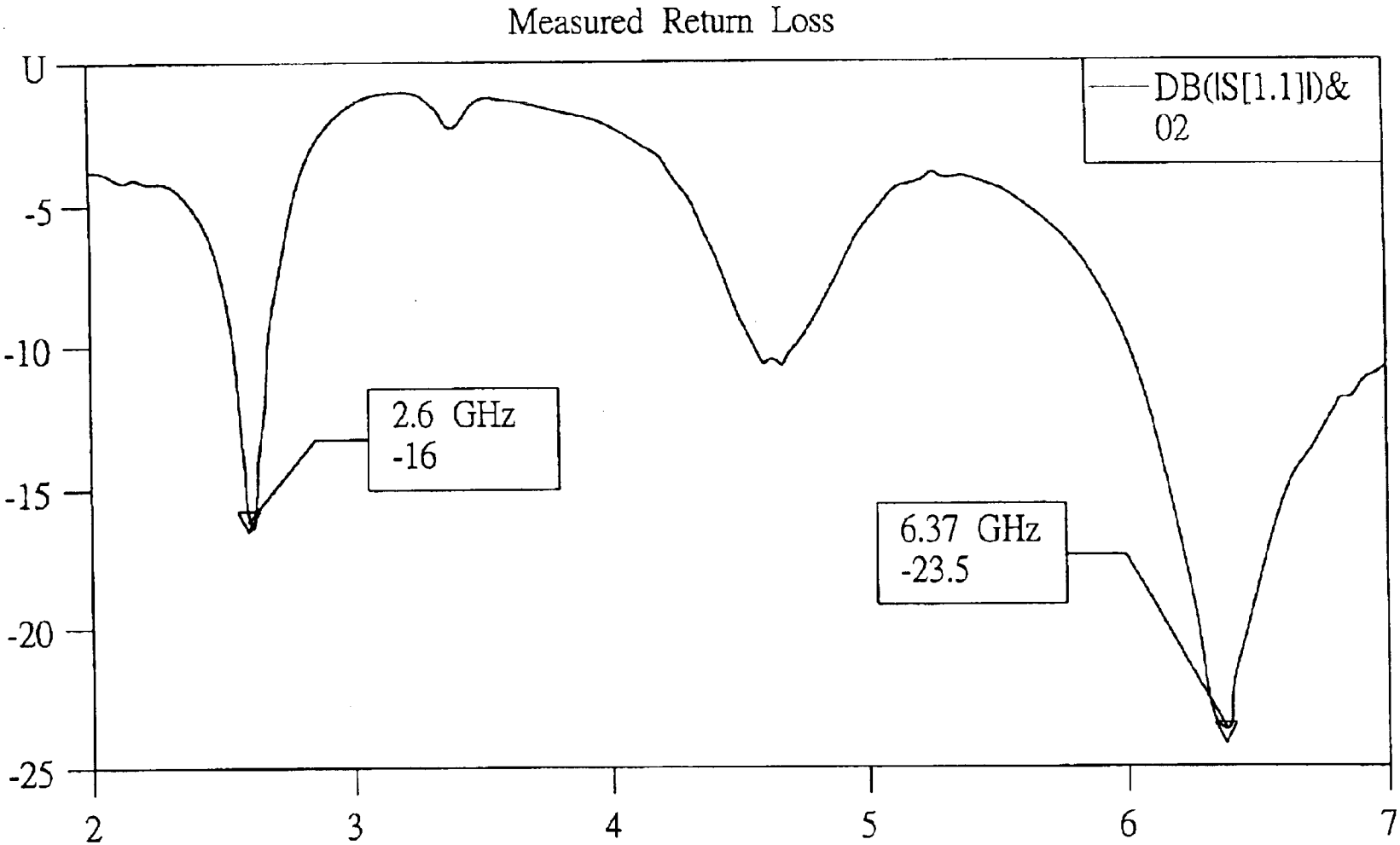
FIG. 7 is a measured return loss for the antenna in FIG. 5 at 2.4 GHz band.
Figure 8:
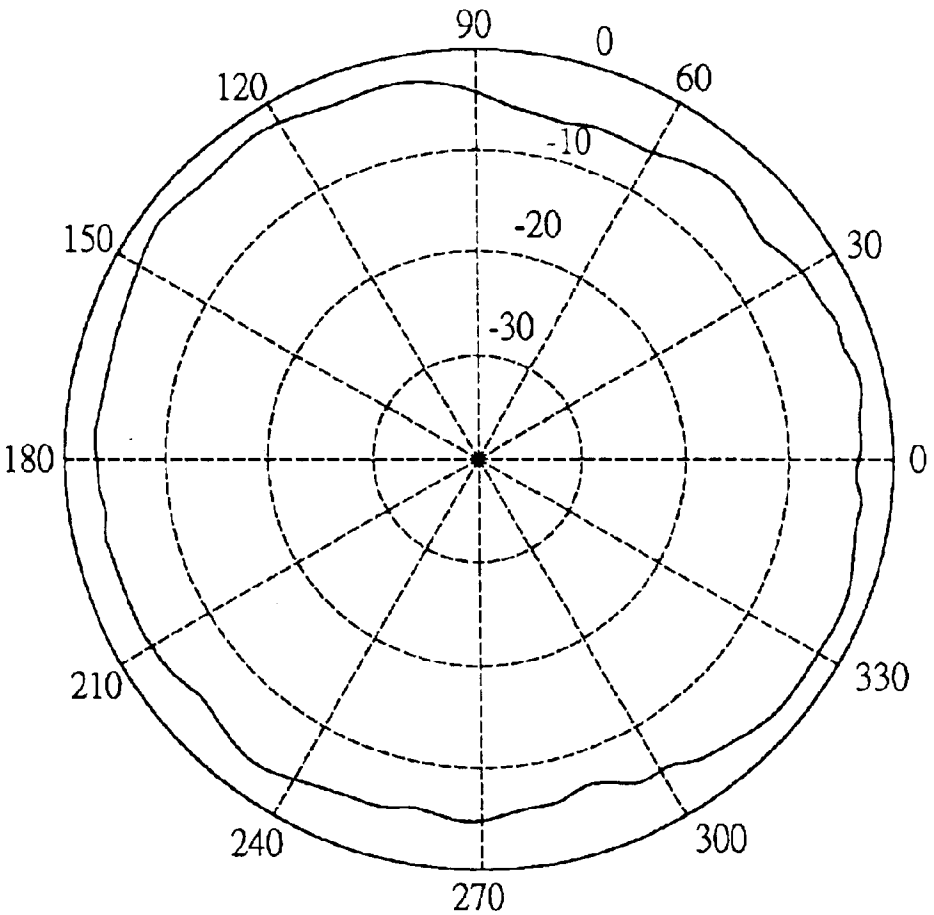
FIG. 8 is a measured radiation gain pattern (typical) of the antenna in FIG. 5 at 2.4 GHz band.
Figure 9:
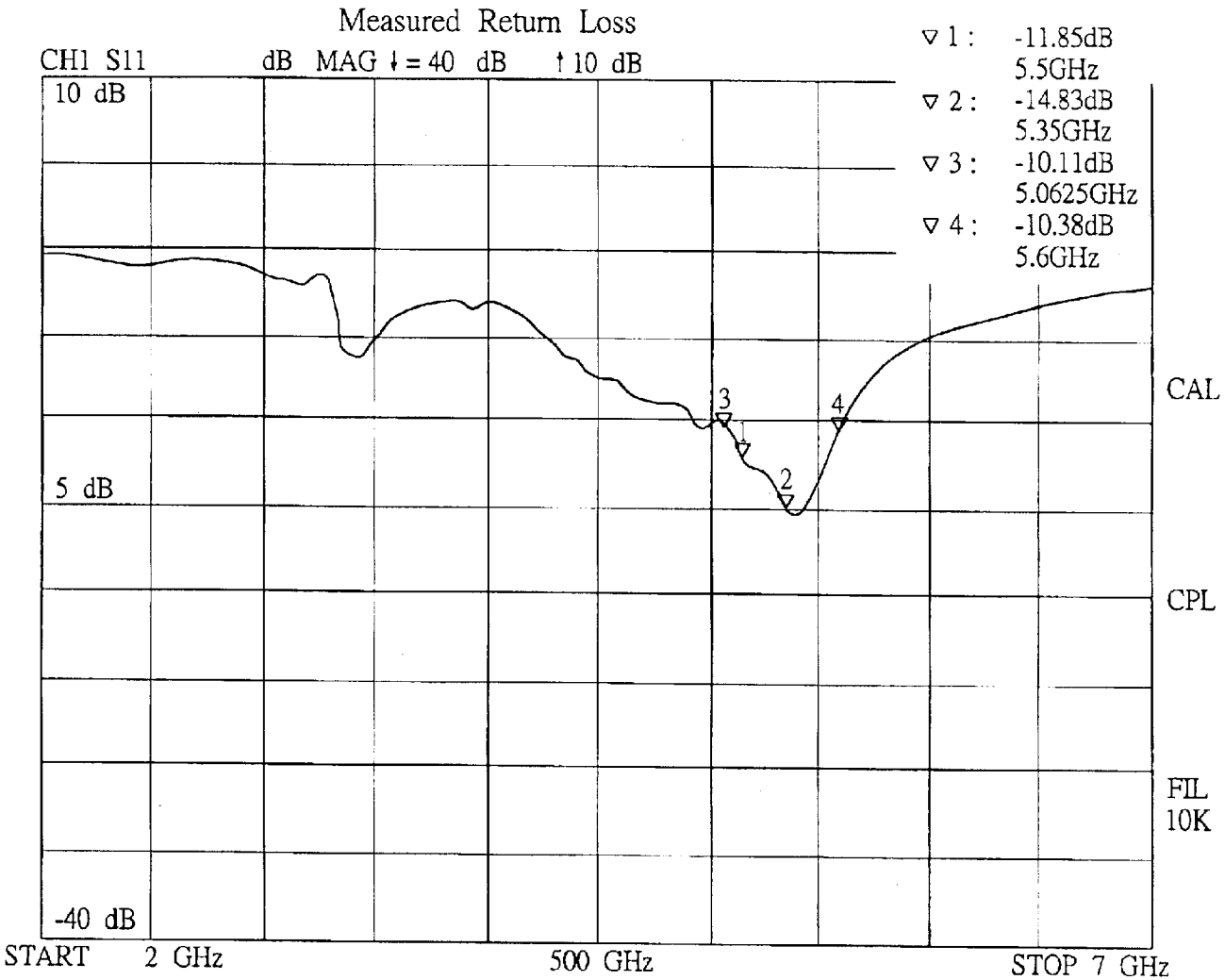
FIG. 9 is a measured return loss for the antenna in FIG. 5 at 5.15 GHz band.
Figure 10:
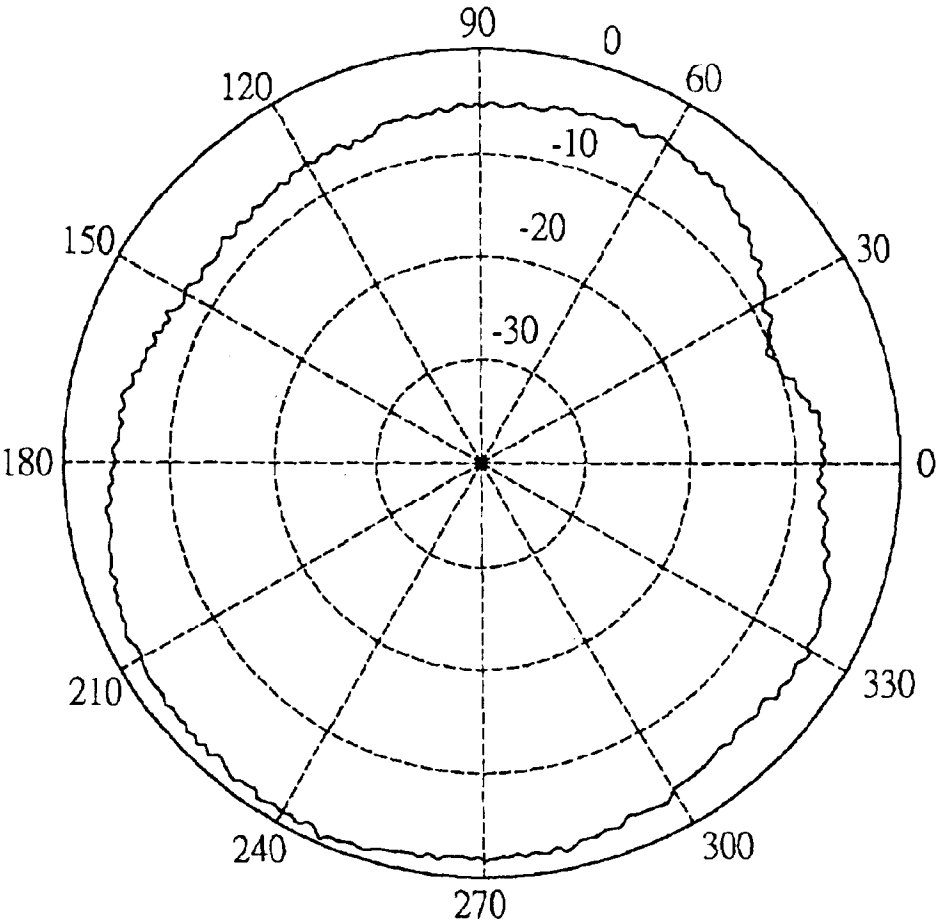
FIG. 10 is a measured radiation gain pattern for the antenna in FIG. 5 at 5.15 GHz band.

With reference to FIG. 7, the measured return loss for 2.4 GHz band is shown. The associated radiation gain pattern measured at frequency of 2.45 GHz for feeding points (401) is given in FIGS. 8 and 5. Also the measured return loss for 5.25 GHz band is shown in FIG. 9, and the measured radiation gain pattern for feeding points (701) is shown in FIG. 10. Based on these measured data, the invented planar diversity antenna has excellent performance in both VSWR and radiation gain pattern, which verified the realizable of this invention.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. This invention is especially suited for embedded antenna applications to integrate with printed-circuits.

What is claimed is:

1. A diversified planar phased array antenna, comprising:

a dielectric plate having a top face and a bottom face;

at least two antenna units formed on the top face, wherein the at least two antenna units are coplanar and are connected perpendicular together by at least one first micro-strip line wherein each of at least two antenna units comprises:

at least two identical Meander line antennas respectively formed on the top face in parallel; and at least one second micro-strip lines each of which is connected between the each at least two meander line antennas; and a ground layer formed on the bottom face corresponding to the micro-strip lines on the top face and unconnected to the micro-strip lines and the at least two antenna units formed on the top face of the dielectric plate.

2. The planar phased array antenna as claimed in claim 1, wherein four antenna units formed on the dielectric plate are respectively coplanar and are connected perpendicular together by two first microstrip lines.

3. The planar phased array antenna as claimed in claim 2, wherein a micro-strip feed line is connected to the two first micro-strip lines.

4. The planar phased array antenna as claimed in claim 1, wherein the at least two antenna units are printed on the top face.

5. The planar phased array antenna as claimed in claim 1, wherein the dielectric plate is L-shaped.

6. The planar phased array antenna as claimed in claim 1, wherein the dielectric plate is made of a FR-4, mylar, ceramic or kapton dielectric material.

* * * * *